United States Patent [19]

Walker

[11] Patent Number: 4,493,604

[45] Date of Patent: Jan. 15, 1985

[54] FORK LIFT CLAMP APPARATUS

[75] Inventor: Evo M. Walker, Louisville, Miss.

[73] Assignee: Taylor Machine Works, Inc., Louisville, Miss.

[21] Appl. No.: 434,348

[22] Filed: Oct. 14, 1982

[51] Int. Cl.[3] ..... B66F 9/18

[52] U.S. Cl. ..... 414/622; 294/67 AB; 294/104; 414/623; 414/745

[58] Field of Search ..... 414/622, 623, 745, 607, 414/740; 294/67 AB, 104

[56] References Cited

U.S. PATENT DOCUMENTS

| | | | |
|---|---|---|---|
| 3,119,637 | 1/1964 | Eaves | 414/622 X |
| 3,124,263 | 3/1964 | Eaves | 414/622 |
| 3,194,421 | 7/1965 | Lull | 294/104 X |
| 3,817,567 | 6/1974 | Lull | 414/622 X |
| 4,266,819 | 5/1981 | Pemberton | 414/622 X |

*Primary Examiner*—Joseph E. Valenza
*Assistant Examiner*—Stuart Millman
*Attorney, Agent, or Firm*—Walker & McKenzie

[57] ABSTRACT

An apparatus for clamping pipes and the like to the forks of a forklift truck. A flapper arm is pivotally attached to a frame member which straddles each fork of the truck. A clamp arm is pivotally attached to the opposite end of the flapper arm. A single piston extends between the frame member and clamp arm to cause the clamp arm to move between opened and closed positions.

5 Claims, 24 Drawing Figures

FORK LIFT CLAMP APPARATUS

BACKGROUND OF THE INVENTION

1. Field of the Invention

The present invention relates, in general, to attachments for allowing pipes and the like to be handled with standard forklift trucks and the like.

2. Description of the Prior Art

Various attachments have been developed for use with forklift trucks and the like to aid in the handling of logs, pipes and the like. See, for example, Dunham, U.S. Pat. No. 2,997,193; Eaves, U.S. Pat. No. 3,119,637; Eaves, U.S. Pat. No. 3,124,263; Lull, U.S. Pat. No. 3,409,157; Lull, U.S. Pat. No. 3,817,567; and Pemberton, U.S. Pat. No. 4,266,819. None of the above patents disclose or suggest the present invention.

Typical prior art mechanisms for use with mobile loaders or trucks to help handle elongated pipes and the like consist of a separate fork-grapple carriage assembly for being mounted on the boom or mast assembly of the truck in place of the standard fork carriage. See, for example, the carriage of the above-identified Lull '567 patent that includes a frame for being attached to the boom of a mobile loader and a pair of forks and coacting hold down-fingers attached to the frame to allow the carriage to lift and carry long pipe, conduit and the like.

SUMMARY OF THE INVENTION

The present invention is directed toward improving existing forklift-type trucks by providing a low-cost, simple clamp apparatus that can be quickly attached to the carriage of the truck without requiring the forks of the truck to be replaced or requiring any substantial modification to the truck or carriage and that will allow the truck to be used in handling all types and sizes of pipes and the like. The clamp apparatus of the present invention includes, in general, a frame member for straddling the fork member of a forklift truck and for being pivotally attached to the pivot rod of the forklift truck used to pivotally attach the fork member to the carriage of the truck, the frame member having an upper and a lower end; a flapper arm having a first end and a second end, the first end of the flapper arm being pivotally attached to the frame member substantially adjacent the lower end thereof; a clamp arm having a first end and a second end, the first end of the clamp arm being pivotally attached to the flapper arms substantially adjacent the second end thereof; and a piston means having a first end and a second end, the first end of the piston means being attached to the frame member substantially adjacent the upper end thereof and the second end of the piston means being attached to the clamp arm substantially intermediate the first and second ends thereof, movement of the piston means causing the clamp arm to move between an opened position for allowing pipes and the like to be loaded onto and off-of the fork member of the truck and a closed position for clamping pipes and the like onto the fork member.

DESCRIPTION OF THE PREFERRED EMBODIMENT

Figure 1:
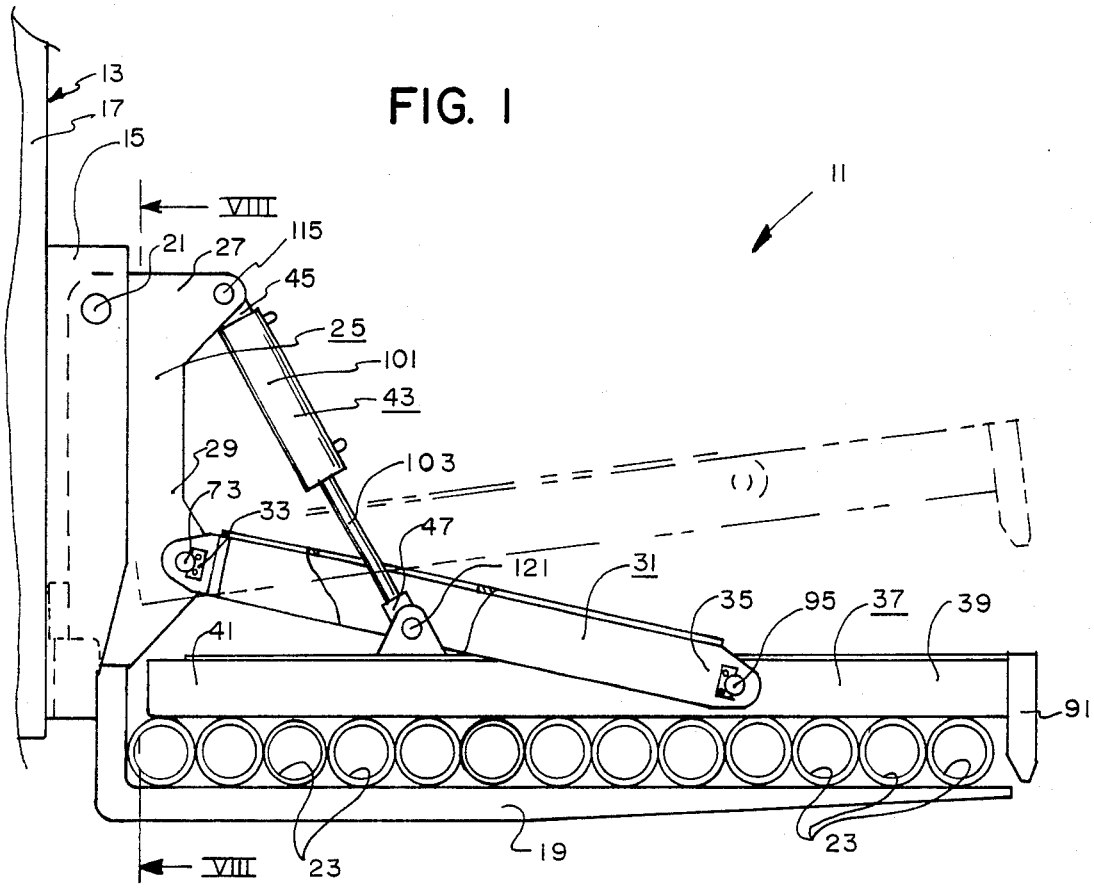
FIG. 1 is a side elevational view of the forklift clamp apparatus of the present invention, with portions of a forklift truck shown in broken lines with portions broken away for clarity.
Figure 2:
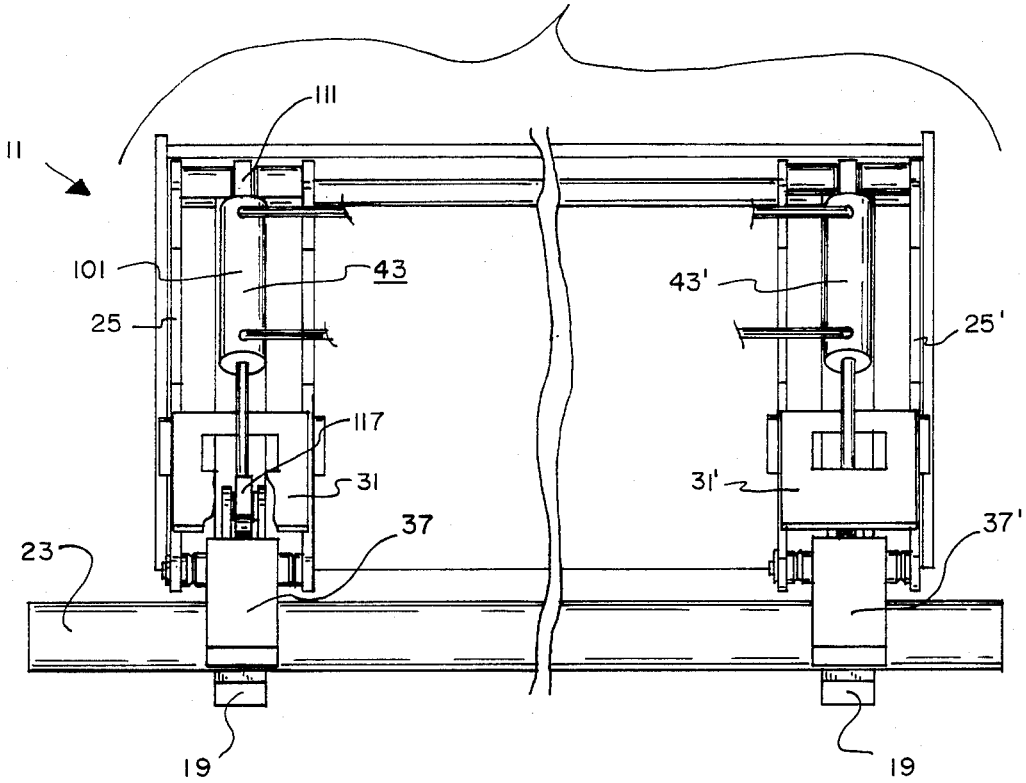
FIG. 2 is a front elevational view of FIG. 1.
Figure 3:
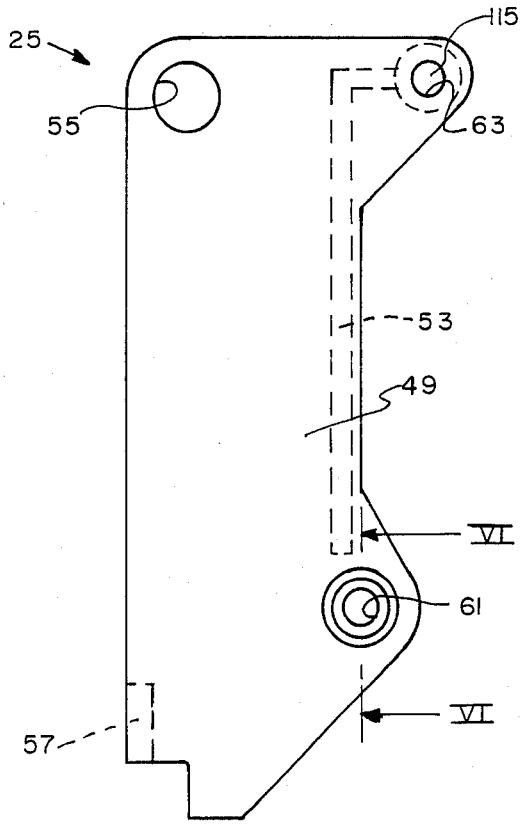
FIG. 3 is a side elevational view of a frame member of the clamp apparatus.

The clamp apparatus 11 of the present invention is for use with a typical forklift truck 13 of the type preferably including a carriage 15 movably mounted on a mast 17, a pair of L-shaped fork members 19, and a pivot rod 21 for pivotally attaching the fork members 19 to the carriage 15 (see, in general, FIGS. 1 and 2). The clamp apparatus 11 is for use as an attachment to the forklift truck 13 to allow the forklift truck 13 to safely and securely handle elongated pipes 23 and the like.

The clamp apparatus 11 includes a frame member 25 for straddling one of the fork members 19 and for being pivotally attached to the pivot rod 21. The frame member 25 has an upper end 27 and a lower end 29.

The clamp apparatus 11 includes a flapper arm 31 having a first end 33 and a second one 35. The first end 33 of the flapper arm 31 is pivotally attached to the frame member 25 substantially adjacent the lower end 29 thereof.

The clamp apparatus 11 includes a clamp arm 37 having a first end 39 and a second end 41. The clamp arm 37 is pivotally attached to the second end 35 of the flapper arm 31 substantially adjacent the first end 39 thereof.

The clamp apparatus 11 includes a piston means 43 having a first end 45 and a second end 47. The first end 45 of the piston means 43 is attached to the frame member 25 substantially adjacent the upper end 27 thereof. The second end 47 of the piston means 43 is attached to the clamp arm 37 substantially intermediate the first and second ends 39, 41 thereof. Movement of the first and second ends 45, 47 of the piston means 43 toward or away from one another will cause the clamp arm 37 to move between an opened position as shown in broken lines in FIG. 1 for allowing pipes 23 and the like to be loaded onto and off-of the fork members 19 and a closed position as shown in solid lines in FIG. 1 for clamping pipes 23 and the like onto the fork members 19.

The specific constuction of the individual elements of the clamp apparatus 11 may vary as will be apparent to those skilled in the art. Thus, the frame member 25 preferably includes a first side member 49, a second side member 51, and a cross member 53 joining the first and second side members 49, 51 together. An aperture 55 is provided through the upper end of each side member 49, 51 to allow the pivot rod 21 to pass therethrough whereby the frame member 25 is pivotally attached to the pivot rod 21 with the side members 49, 51 straddling a fork member 19. A lower cross member 57 preferably extends between the first and second side members 49, 51 for coacting with a stop member 59 provided on the carriage 15 to prevent undesired pivotal movement of the frame member 25 about the pivot rod 21. An aperture 61 is provided through each side member 49, 51 substantially adjacent the lower ends thereof to allow the first end 33 of the flapper arm 31 to be pivotally attached therethrough in a manner which will hereinafter become apparent. An aperture 63 is provided through each side member 41, 51 adjacent the upper end thereof for allowing the first end 45 of the piston means 43 to be pivotally attached thereto in a manner which will hereinafter become apparent.

Figure 11:
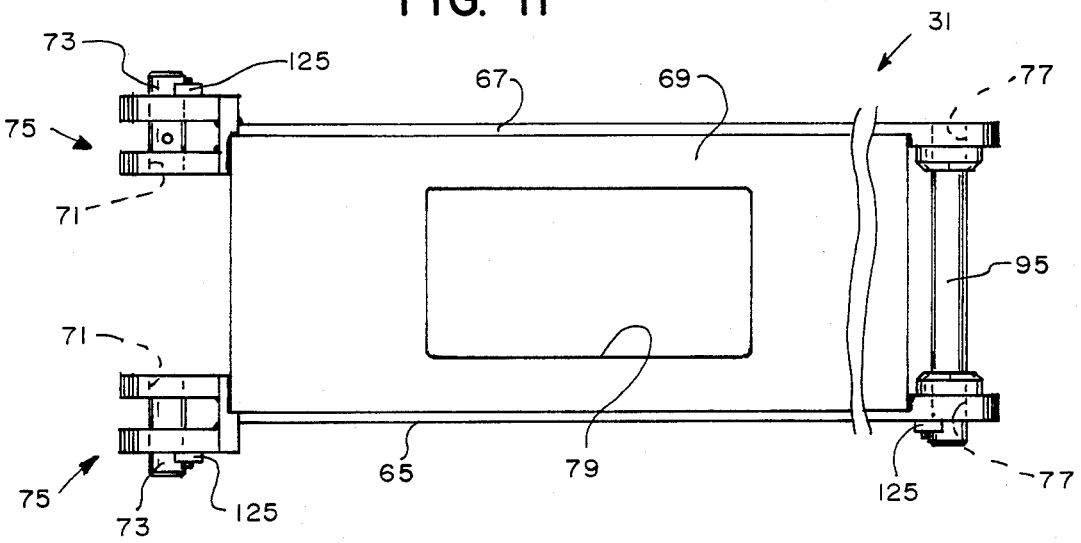
FIG. 11 is a top plan view of FIG. 10.
Figure 12:
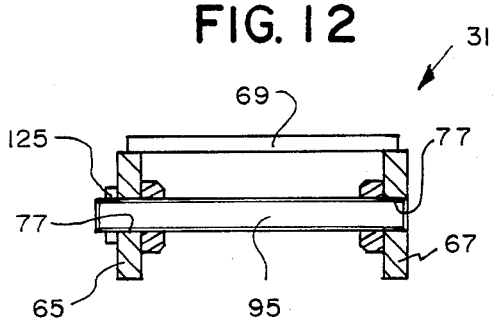
FIG. 12 is a sectional view as taken on line XII—XII of FIG. 10.
Figure 13:
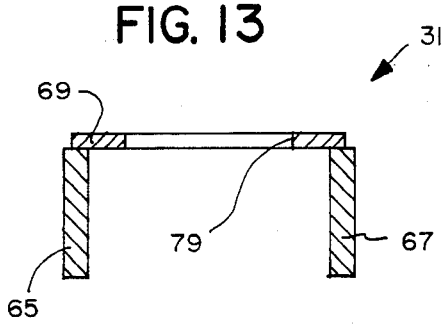
FIG. 13 is a sectional view as taken on line XIII—XIII of FIG. 10.

The flapper arm 31 preferably includes a first side member 65 and a second side member 67 joined to one another in a spaced-apart relation by a top member 69. Apertures 71 may be provided through a first end of each side member 65, 67 for allowing the flapper arm 31 to be attached to the lower end 29 of the frame member 25. More specifically, pivot rods 73 may be provided for extending through the apertures 71 in the flapper arm 31 and the apertures 61 in the frame member 29 to thereby pivotally attach the flapper arm 31 to the frame member 25 substantially adjacent the lower end 29 thereof. The first and second side members 65, 67 may be provided with bifurcated portions 75 as shown in FIG. 11 for straddling the first and second side members 49, 51 adjacent the apertures 61. As second end of each side member 65, 67 is preferably provided with an aperture 77 for allowing the second end 35 of the flapper arm 31 to be pivotally attached to the clamp arm 37 in a manner which will hereinafter become apparent. An elongated aperture 79 is preferably provided through the top member 69 substantially intermediate the first and second ends 33, 35 of the flapper arm 31 for reasons which will hereinafter become apparent.

Figure 14:
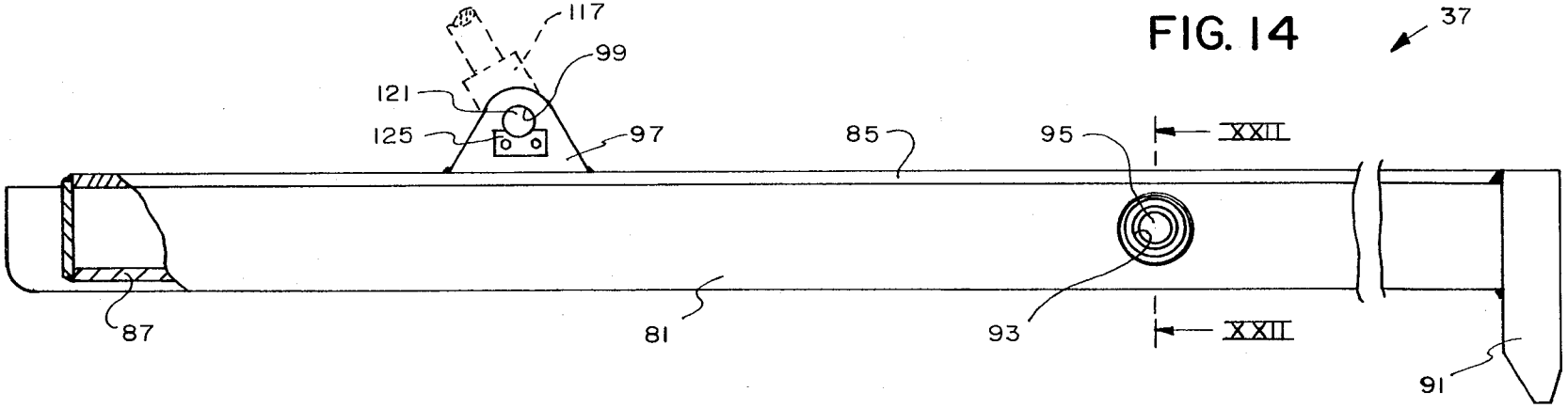
FIG. 14 is a side elevational view of a clamp arm of the clamp apparatus with portions thereof broken away for clarity.
Figure 15:
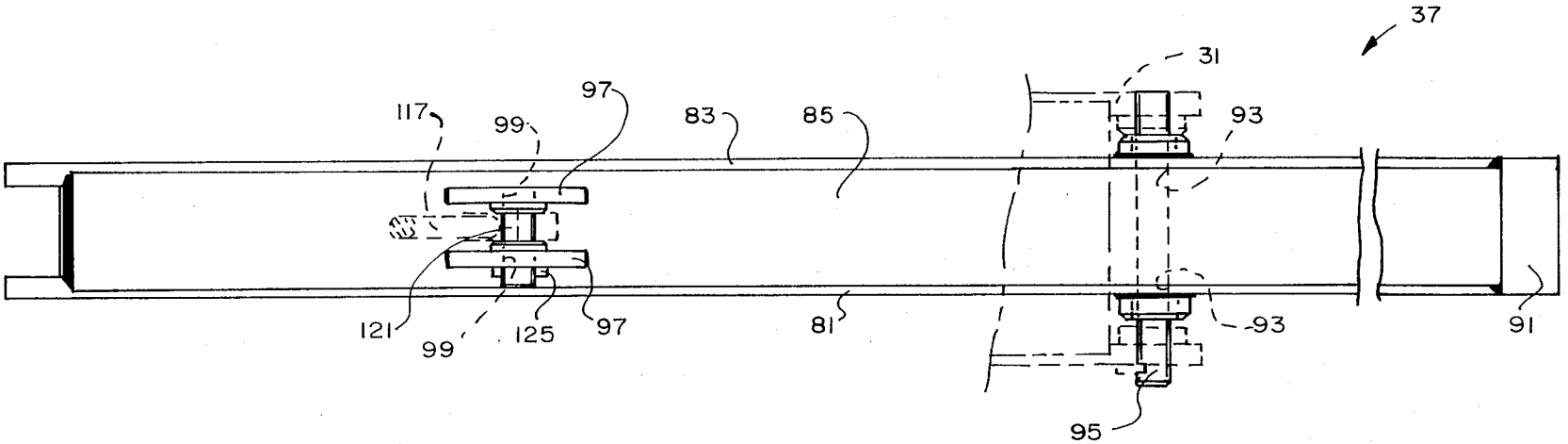
FIG. 15 is a top plan view of FIG. 14.

The clamp arm 37 preferably includes first and second side members 81, 83 fixedly joined together in a spaced-apart relation by a top member 85 and a bottom member 87 to thereby form an elongated boxlike member 89. A downturned foot portion 91 is preferably attached to a first end of the elongated boxlike member 89 (see FIG. 14) for reasons which will hereinafter become apparent. An aperture 93 is preferably provided through each side member 81, 83 for allowing the second end 35 of the flapper arm 31 to be pivotally attached to the clamp arm 37. Thus, a pivot rod 95 is preferably provided for passing through the apertures 93 in the side members 81, 83 of the clamp arm 37 and through the apertures 77 in the side members 65, 67 of the flapper arm 31 to thereby pivotally attach the flapper arm 31 and clamp arm 37 to one another (see, in general, FIGS. 11, 15, 18, 19). One or two upwardly directed tab members 97 having apertures 99 therethrough are preferably fixedly attached to the top member 85 of the clamp arm 37 for allowing the second end 47 of the piston means 43 to be pivotally attached thereto in a manner which will hereinafter become apparent.

Figure 4:
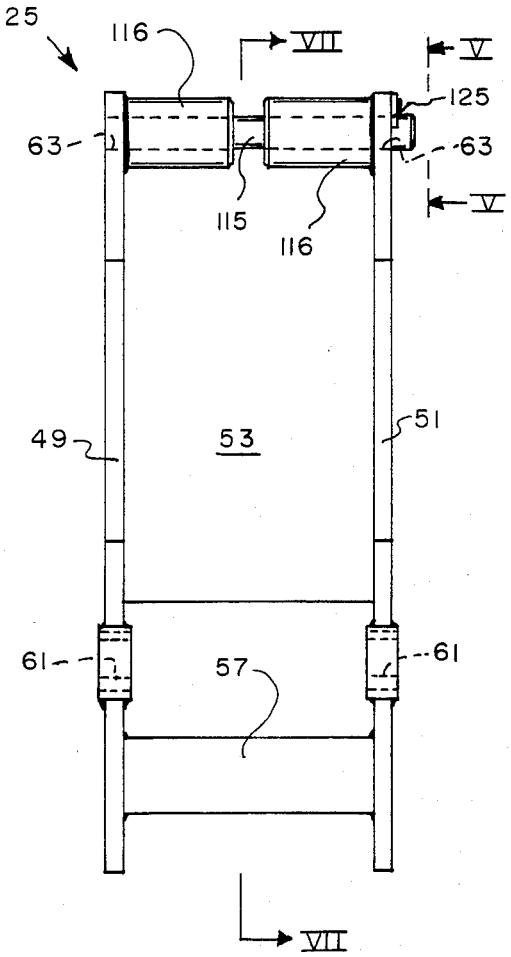
FIG. 4 is a front elevational view of FIG. 3.
Figure 5:
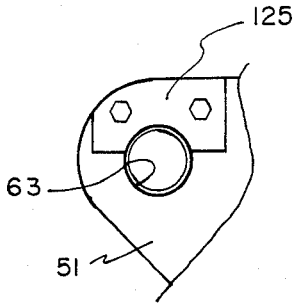
FIG. 5 is an enlarged view of a portion of the frame member as taken on line V—V of FIG. 4.
Figure 6:
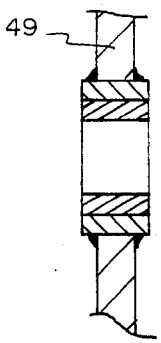
FIG. 6 is an enlarged sectional view as taken on line VI—VI of FIG. 3.
Figure 7:
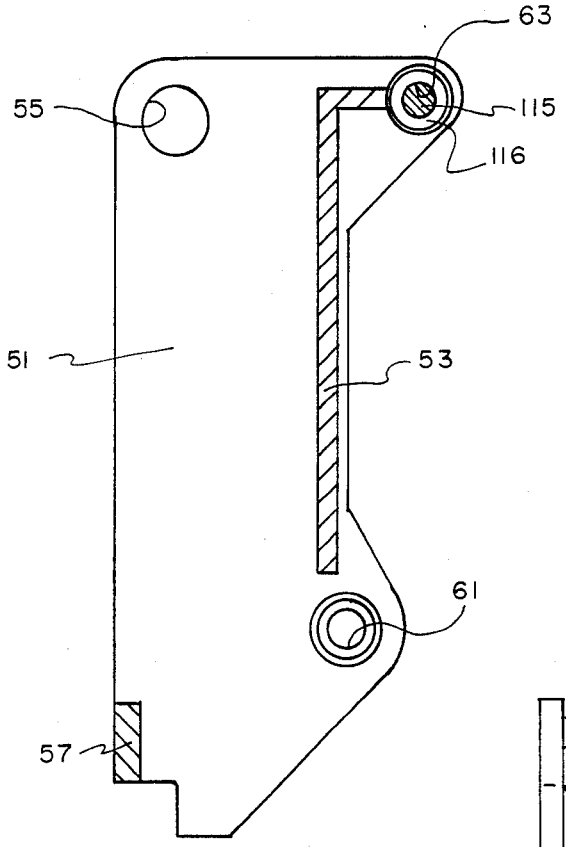
FIG. 7 is a sectional view as taken on line VII—VII of FIG. 4.
Figure 8:
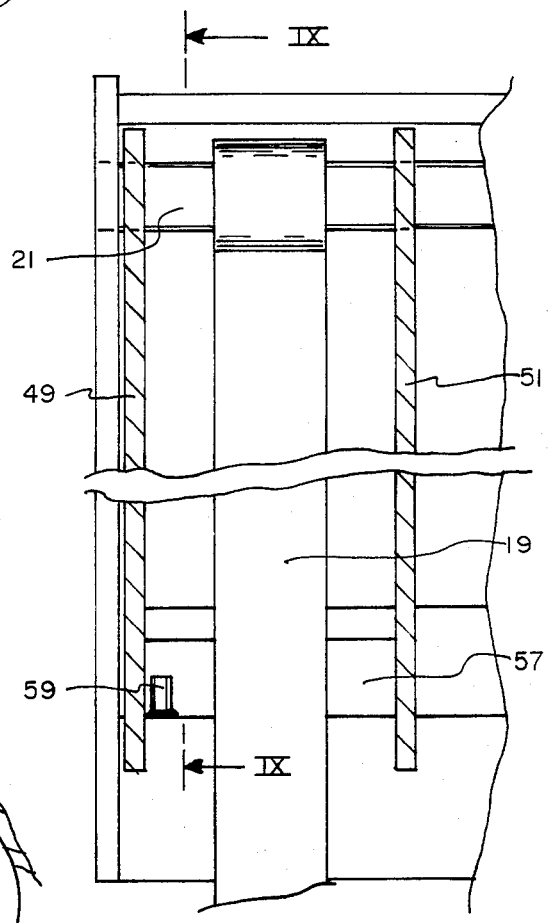
FIG. 8 is an enlarged sectional view as taken on line VIII—VIII of FIG. 1 with portions thereof broken away for clarity.
Figure 9:
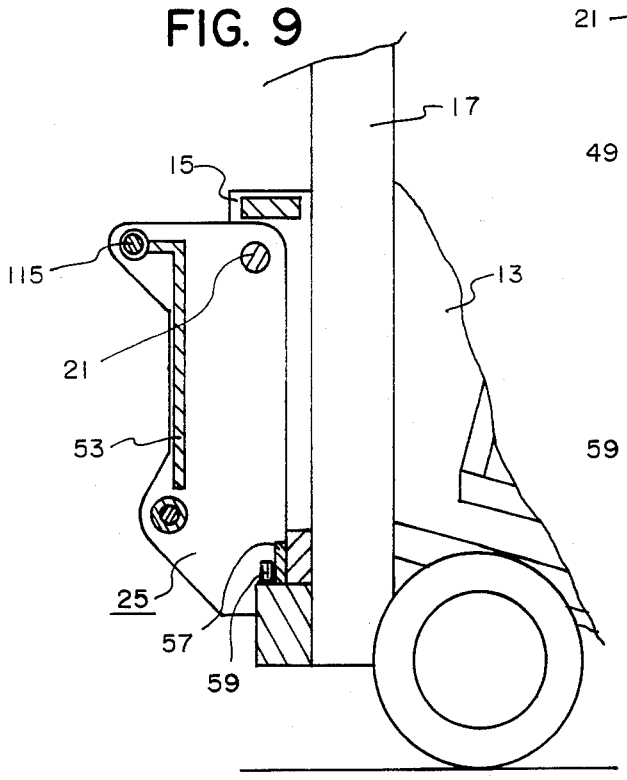
FIG. 9 is a sectional view as taken on line IX—IX of FIG. 8 with portions thereof broken away for clarity.
Figure 10:
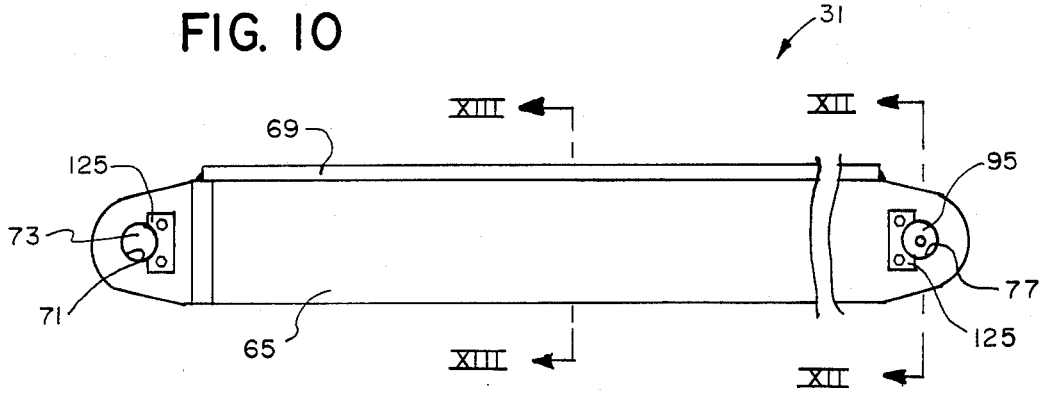
FIG. 10 is a side elevational view of a flapper arm of the clamp apparatus with portions thereof broken away for clarity.
Figure 16:
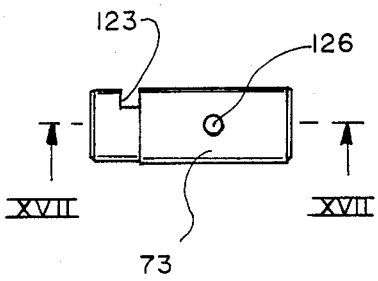
FIG. 16 is a side elevational view of a pivot rod of the clamp apparatus.
Figure 17:
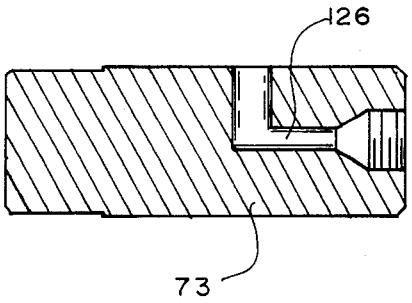
FIG. 17 is an enlarged sectional view as taken on line XVII—XVII of FIG. 16.
Figure 18:
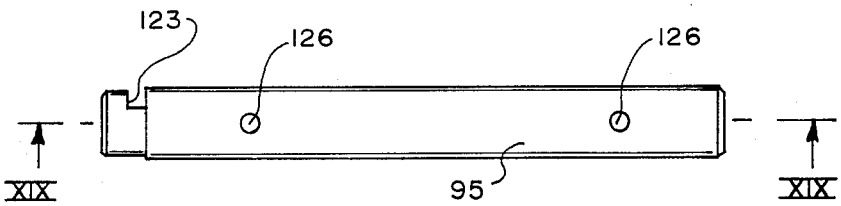
FIG. 18 is a side elevational view of another pivot rod of the clamp apparatus.
Figure 19:
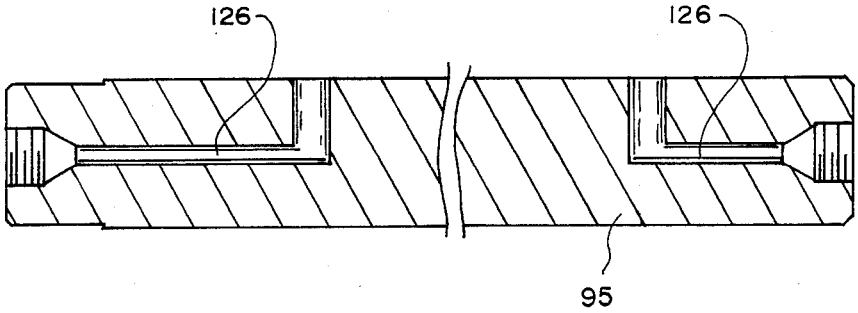
FIG. 19 is an enlarged sectional view as taken on line XIX—XIX of FIG. 18 with portions broken away for clarity.
Figure 20:
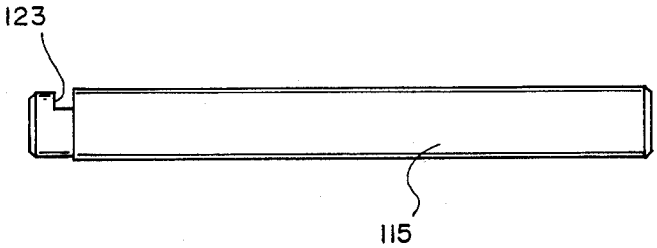
FIG. 20 is a side elevational view of another pivot rod of the clamp apparatus.
Figure 21:
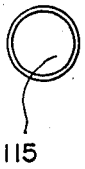
FIG. 21 is an end elevational view of FIG. 20.
Figure 22:
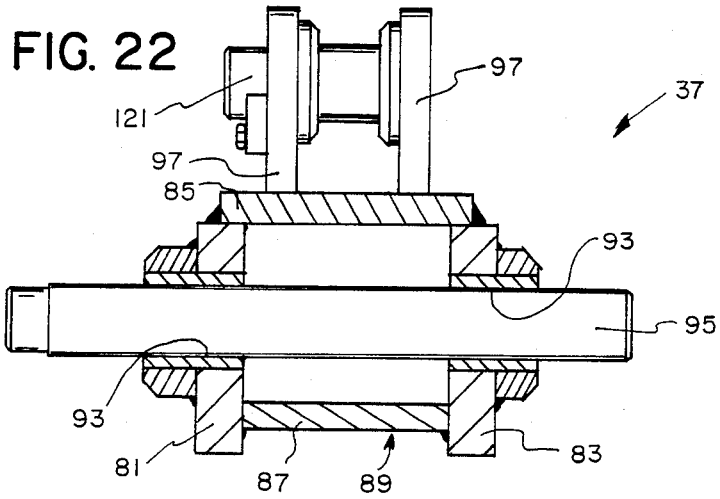
FIG. 22 is an enlarged sectional view as taken on line XXII—XXII of FIG. 14.

The piston means 43 is preferably a substantially standard hydraulic piston having a piston cylinder 101 and a piston rod 103 and operated by the standard hydraulic system 105 of the forklift truck 13 (see FIGS. 23 and 24) through hydraulic lines 107 and by one or more control valves 109 that can be operated from the console of the forklift truck 13. The end of the piston cylinder 101 preferably includes a tab member 111 having an aperture therethrough to allow the hydraulic cylinder 101 to be pivotally attached to the frame member 25 by way of a pivot rod 115 passing through the apertures 63 in the side members 49, 51 of the frame member 25 and through the aperture in the tab member 111 of the piston cylinder 101 whereby the first end 45 of the piston means 43 is pivotally attached to the frame member 25 substantially adjacent the upper end 27 thereof. Spacers 116 may be provided on the frame member 25 about the pivot rod 115 (see, in general, FIGS. 4, 20, 21) to position the tab member 111 and the piston cylinder substantially centrally of its side members 41, 51. A tab member 117 having an aperture therethrough preferably provided on the end of the piston rod 103 whereby the piston rod 103 can be pivotally attached to the clamp arm 37 by way of a pivot rod 121 passing through the apertures 99 in the tab members 97 of the clamp arm 37 and through the aperture through the tab member 117 of the piston rod 103 whereby the second end 47 of the piston means 43 is pivotally attached to the clamp arm 37 substantially intermediate the first and second ends 39, 41 thereof with the piston means 43 passing through the aperture 79 in the top member 69 of the flapper arm 31. The pivot rods 121 are substantially similar to the pivot rods 73 as shown in FIGS. 16 and 17.

The various pivot rods may be adapted to be securely fixed in position in any manner apparent to those skilled in the art. Preferably, the pivot rods may be provided with a transverse slot 123 for coacting with a plate member 125 in such a manner so as to securely fix the pivot rods in position.

The various pivot rods may also be provided with means 126 for allowing grease or the like to be provided to each pivotal joint in any manner apparent to those skilled in the art (see, in general, FIGS. 16–19). The surfaces of the apparatus 11 that are subject to wear may also be provided with any typical bearing structure or the like as will be apparent to those skilled in the art.

Figure 23:
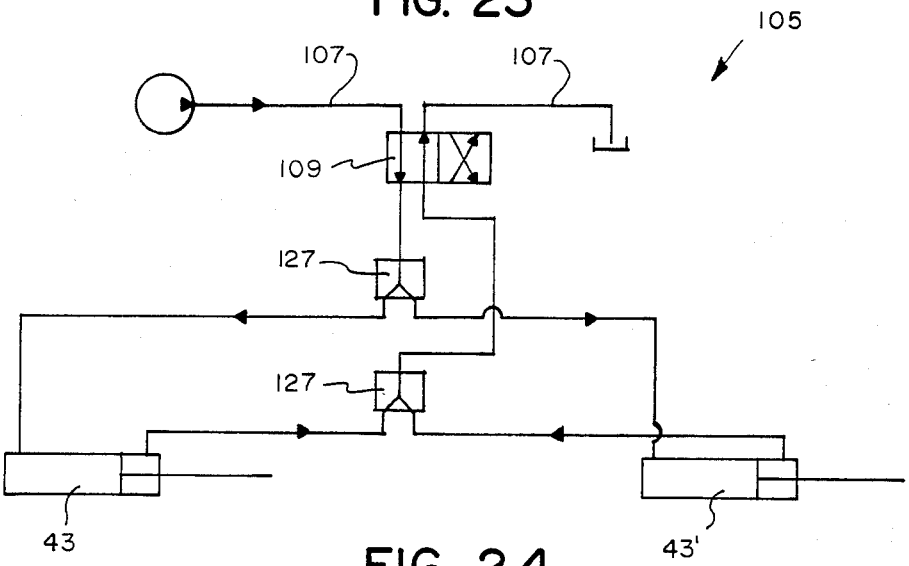
FIG. 23 is a schematic view of the hydraulic system of the clamp apparatus.
Figure 24:
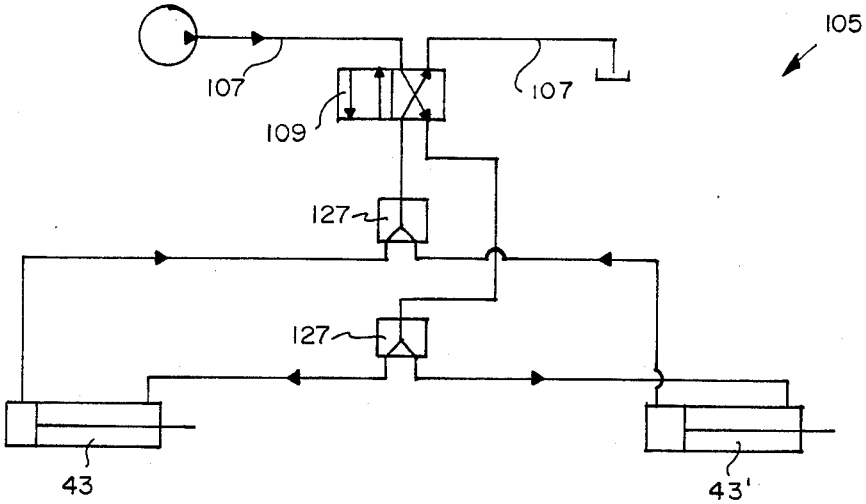
FIG. 24 is similar to FIG. 23 but with certain elements shown in moved positions.

The clamp apparatus 11 preferably includes substantially identical structure to that described above for straddling each fork member 19 of the forklift truck 13. Thus, for example, the clamp apparatus 11 shown in FIG. 2 includes a second frame member 25', a second flapper arm 31', a second clamp arm 37' and a second piston means 43', all constructed and operated identical to the corresponding elements described hereabove. In such cases, flow dividers 127 are provided in the hydraulic lines 107 substantially as shown in FIGS. 23 and 24.

Although the present invention has been described and illustrated with respect to a preferred embodiment thereof and a preferred use therefor, it is not to be so limited since changes and modifications can be made therein which are within the full intended scope of the invention.

I claim:

1. A clamp apparatus for use with a forklift truck of the type including a carriage, an L-shaped fork member, and a pivot rod for pivotally attaching said fork members to said carriage, said clamp apparatus comprising:

(a) a frame member for straddling said fork member and for being pivotally attached to said pivot rod, said frame member having an upper end and a lower end;

(b) a flapper arm having a first end and a second end, said first end being pivotally attached to said frame member substantially adjacent said lower end of said frame member;

(c) a clamp arm having a first end and a second end, a portion of said clamp arm located between said ends of said clamp arm being pivotally attached to said flapper arm substantially adjacent said second end of said flapper arm; and (d) piston means having a first end and a second end, said first end of said piston means being attached to said frame member substantially adjacent said upper end of said frame member, said second end of said piston means being attached to said clamp arm substantially intermediate said first and second ends of said clamp arm, movement of said first and second ends of said piston means toward and away from one another causing said clamping arm to move between an opened position for allowing pipes and the like to be loaded onto and off-of said fork member and a closed position for clamping pipes and the like onto said fork member.

2. The clamp apparatus of claim 1 in which said flapper arm has an aperture therethrough for allowing said piston means to extend therethrough.

3. The clamp apparatus of claim 2 in which said forklift truck includes a hydraulic system for controlling said piston means.

4. The clamp apparatus of claim 3 in which said forklift truck includes a second L-shaped fork member pivotally attached to said carriage by said pivot rod, and in which said clamp apparatus includes:

(a) a second frame member for straddling said second fork member and for being pivotally attached to said pivot rod, said second frame member having an upper end and a lower end;

(b) a second flapper arm having a first end and a second end, said first end being pivotally attached to said second frame member substantially adjacent said lower end of said second frame member;

(c) a second clamp arm having a first end and a second end, a portion of said second clamp arm located between said ends of said second clamp arm being pivotally attached to said second flapper arm substantially adjacent said second end of said second flapper arm; and (d) second piston means having a first end and a second end, said first end of said second piston means being attached to said second frame member substantially adjacent said upper end of said second frame member, said second end of said second piston means being attached to said second clamp arm substantially intermediate said first and second ends of said second clamp arm, movement of said first and second ends of said second piston means toward and away from one another causing said second clamp arm to move between an opened position for allowing pipes and the like to be loaded onto and off-of said second fork member and a closed position for clamping pipes and the like onto said second fork member.

5. The clamp apparatus of claim 4 in which is included flow divider means for allowing said hydraulic system of said forklift truck to be used to control said piston means and said second piston means simultaneously.

* * * * *